US006996860B1

(12) United States Patent
Blake et al.

(10) Patent No.: US 6,996,860 B1
(45) Date of Patent: Feb. 14, 2006

(54) CONSTRUCTION PROTECTIVE COVERING

(76) Inventors: Raymond A. Blake, 18101 Armada Center Rd., Armada, MI (US) 48005; Michael P. Blake, 18101 Armada Center Rd., Armada, MI (US) 48005

( * ) Notice: Subject to any disclaimer, the term of this patent is extended or adjusted under 35 U.S.C. 154(b) by 0 days.

(21) Appl. No.: 10/163,778

(22) Filed: Jun. 6, 2002

Related U.S. Application Data

(60) Provisional application No. 60/296,348, filed on Jun. 6, 2001.

(51) Int. Cl.
*A47K 3/02* (2006.01)

(52) U.S. Cl. ..... 4/580; 4/504; 4/498

(58) Field of Classification Search ..... 4/580, 4/557, 504, 498, 597, 605; 52/35
See application file for complete search history.

(56) References Cited

U.S. PATENT DOCUMENTS

| | | | | | |
|---|---|---|---|---|---|
| 1,570,164 | A | | 1/1926 | Mayer | |
| 1,571,335 | A | | 2/1926 | Jarvis | |
| 1,588,799 | A | | 6/1926 | Nilson | |
| 1,715,534 | A | | 6/1929 | Burnham | |
| 1,825,355 | A | * | 9/1931 | Keefe | 4/601 |
| 1,826,010 | A | * | 10/1931 | McCann | 4/580 |
| 1,861,495 | A | | 6/1932 | Gould | |
| 2,119,210 | A | * | 5/1938 | Hall | 4/580 |
| 2,510,933 | A | * | 6/1950 | Roach | 4/580 |
| 2,575,236 | A | | 11/1951 | Slawson | |
| 2,642,580 | A | | 6/1953 | Gibb | |
| 2,717,018 | A | * | 9/1955 | Wagner | 150/154 |
| 3,045,254 | A | | 7/1962 | Cook et al. | |
| 3,133,292 | A | * | 5/1964 | Spier | 4/580 |
| 3,139,627 | A | * | 7/1964 | Rice | 52/35 |
| 3,460,167 | A | | 8/1969 | Benjamin | |
| 3,969,563 | A | * | 7/1976 | Hollis, Sr. | 428/175 |
| 4,067,071 | A | | 1/1978 | Altman et al. | |
| 4,299,064 | A | * | 11/1981 | Daniels | 52/35 |
| 4,310,995 | A | * | 1/1982 | Hanna | 52/793.1 |
| 4,463,043 | A | * | 7/1984 | Reeves et al. | 428/68 |
| 4,662,777 | A | * | 5/1987 | Newton | 404/25 |
| 4,765,000 | A | * | 8/1988 | Currie | 4/580 |
| 4,869,456 | A | * | 9/1989 | Jacobs | 248/678 |
| 4,970,733 | A | * | 11/1990 | Cocciadiferro et al. | 4/580 |
| 4,970,734 | A | * | 11/1990 | Friedman et al. | 4/597 |
| 4,997,694 | A | * | 3/1991 | Legare | 428/71 |
| 5,037,363 | A | | 8/1991 | Cocciadiferro et al. | |
| 5,086,525 | A | | 2/1992 | Christopher | |

(Continued)

*Primary Examiner*—Henry Bennett
*Assistant Examiner*—Amanda Wieker
(74) *Attorney, Agent, or Firm*—Cargill & Associates

(57) ABSTRACT

A construction protective covering for covering and protecting delicate finishes on previously installed bathroom components on a construction job site from damage due to dropped tools and construction workers working in the vicinity of the installed component includes a double skinned, sheeted material protective covering having a center material between the double skins, the protective covering being sized to install within and cover either a bathtub or a shower stall enclosure including its front face and floor, the sheeted material having a thickness of from about ⅛" to about 5" thick, such that the sheeted material covering protects the shower stall enclosure and its floor. The double skinned protective covering is capable of holding the weight of a heavy construction worker, such that when the construction worker stands on the protective covering over the shower stall enclosure floor to do more work, the worker will be supported by the protective covering so that the worker can work without having to be careful of the delicate finish.

6 Claims, 2 Drawing Sheets

U.S. PATENT DOCUMENTS 5,216,764 A * 6/1993 Hall et al. ..... 4/583
5,329,649 A 7/1994 Turek
5,435,021 A 7/1995 Williams
5,528,994 A * 6/1996 Iseli ..... 108/51.3
5,643,652 A * 7/1997 Maurer et al. ..... 428/116
5,685,031 A 11/1997 Watkins et al.
5,829,071 A 11/1998 Lavalle
5,834,082 A * 11/1998 Day ..... 428/56
5,970,530 A * 10/1999 Hansen et al. ..... 4/498
6,101,642 A 8/2000 Auten et al.
6,112,340 A * 9/2000 Ziebert et al. ..... 4/498

* cited by examiner

CONSTRUCTION PROTECTIVE COVERING

CROSS REFERENCES TO RELATED APPLICATIONS

This application claims the benefit of U.S. Provisional Application Ser. No. 60/296,348 filed on Jun. 6, 2001.

TECHNICAL FIELD

This invention relates to protective coverings for construction sites and more particularly relates to protective coverings for bathroom fixtures to prevent damage.

BACKGROUND OF THE INVENTION

Conventional construction of commercial and residential buildings and repairs tend to require a very exacting sequence of events. Among others, one reason for the critical timing of events in the construction process is because certain objects are easily blemished and costly to correct in terms of time and money. Often when a structure is constructed, the finished surface of the structure is subjected to dropped tools, paint, adhesive and other objectionable contact. Objects which are especially sensitive to scratches, nicks and marring during the construction process are often composed of relatively delicate materials, such as molded fiberglass, steel, marble and precious woods, used in sinks, bathtubs, basins, toilets, bidets, shower stalls, counter tops and fireplace areas, and the like. Such items are often scratched, nicked or marred after their installation in, and during the construction or repair of, houses, buildings, boats, swimming pools, aircrafts and similar structures.

Currently construction workers often protect precious finished surfaces by utilizing techniques that are ineffective. In the past, construction workers have tried using protective materials including drop clothes, towels, bed linen and plywood to protect precious finished surfaces, although they have met with limited effectiveness. While these devices may fulfill their respective, particular objectives and requirements, as protective coverings they can pose dangers to the appearance and value of the precious finished surfaces and may compromise the safety of the construction workers.

The present invention substantially departs from the conventional concepts and designs of current products on the market, and in so doing provides an apparatus primarily developed for the purpose of covering precious finished surfaces during construction or repair. This present invention serves as a shield to prevent objects from coming in contact with the precious finished surface and a platform from which contractors may work. The protective covering of the present invention is reusable, durable and helps to minimize cleaning and repair expenses during and after construction.

It is an object of the present invention to provide a new, more protective temporary bathroom fixture protective covering that can either be disposable or reused. It is also an object of the present invention to utilize modern double-skinned materials which are more lightweight than prior art coverings, and ones that are capable of holding at least 500 pounds so that heavy weight construction workers can be supported on a platform.

It is yet another object of the present invention to provide a novel shower stall protective covering that will be capable of being disposable and lightweight. Further still, the shower stall protective covering would be most advantageous if it could be made of a double skinned material which is lightweight and is capable of protecting the delicate finish of the shower stall material from nicks and scratches made by careless use of construction tools, boots, and the like.

SUMMARY OF THE INVENTION

In accordance with the present invention, there is provided a new construction protective covering which meets and/or exceeds the objects and advantages discussed above. Disclosed is a construction protective covering for covering and protecting delicate finishes on previously installed bathroom components on a construction job site from damage due to dropped tools and construction workers working in the vicinity of the installed components. In addition, a protective covering for shower stall installations is also disclosed. The present protective covering includes a double skinned, sheeted material protective covering with a center material between the double skins. To best protect the bathroom components, the protective covering is sized to cover a standard sized bathtub and wall enclosure area or shower stall. As the bathtub will have a bathtub recess, a front face, and a walled-in enclosure, the protective covering will include a support platform to be supported by the upper lip of the tub and a protective apron to cover the front face of the tub. A protective covering for the wall enclosure above the tub may be included as an integral piece, or may be a separate piece for ease of shipping and handling. The shower stall embodiment will be sized to fit into the shower stall, and may also include a covering for the floor as an integral die cut piece, or the floor may be an individual piece. Slippage is minimized due to the size and configuration of the protective covering as it fits into the bathtub enclosure area.

The material to be preferably used is a double skinned sheeted material having a center material between the two skins, with a thickness of from about ⅛" to about 5" thick, and may be made of any double skinned sheet material including corrugated plastic, cardboard, paper, foamed skinned materials or lightweight composites. The corrugated plastic embodiment may be made of polypropylene, polyethylene, or any other commercially available corrugated plastic, so long as it is lightweight and will not mar the bathroom fixture surface. Further, the double skinned sheet material may be a honeycomb construction having individual honeycomb cell sizes of from about ¼" to about 1" diameter. In addition, double skinned sheet material may be used that has two outer skins and foamed materials thereinbetween. Reinforcement materials may be incorporated into the center foam to aid the rigidity of the unit, thereby enhancing the weight bearing capacity of the protective covering. As the reinforcement will not contact the bathroom fixture surface, it may be of any high strength, yet lightweight material, such as a metal mesh or metallic spun web, both of which are very lightweight and inexpensive.

In the bathtub embodiment, the sheeted material covering is adapted to be level with the top of the bathtub when installed, and is capable of holding the weight of a heavy construction worker, such that when the construction worker stands on the protective covering over the bathtub to do more work on the walls and vicinity of the already installed bathtub, the worker will be supported by the protective covering, and he can work without having to be careful of the delicate finish. In addition, the support platform acts as a mini-scaffold for him so that he can reach the wall up to the ceiling over the bathtub, without having to fit a ladder into the bathtub recess, possibly damaging the installed tub fixture.

For the shower stall embodiment, the sheeted material may be made of all the materials listed above for the bathtub embodiment, although it may be made of an even lighter material as the weight bearing support platform over the bathtub recess is not necessary in this application.

Various embodiments for other bathroom fixtures, such as hot tubs, bidets, water jet tubs, toilets, and any other conventional bathroom fixture which needs protection from workers, can be made from the above described double skinned materials without any undue experimentation, and is contemplated by the present inventors within the scope of this invention.

DETAILED DESCRIPTION OF THE INVENTION

Figure 1:
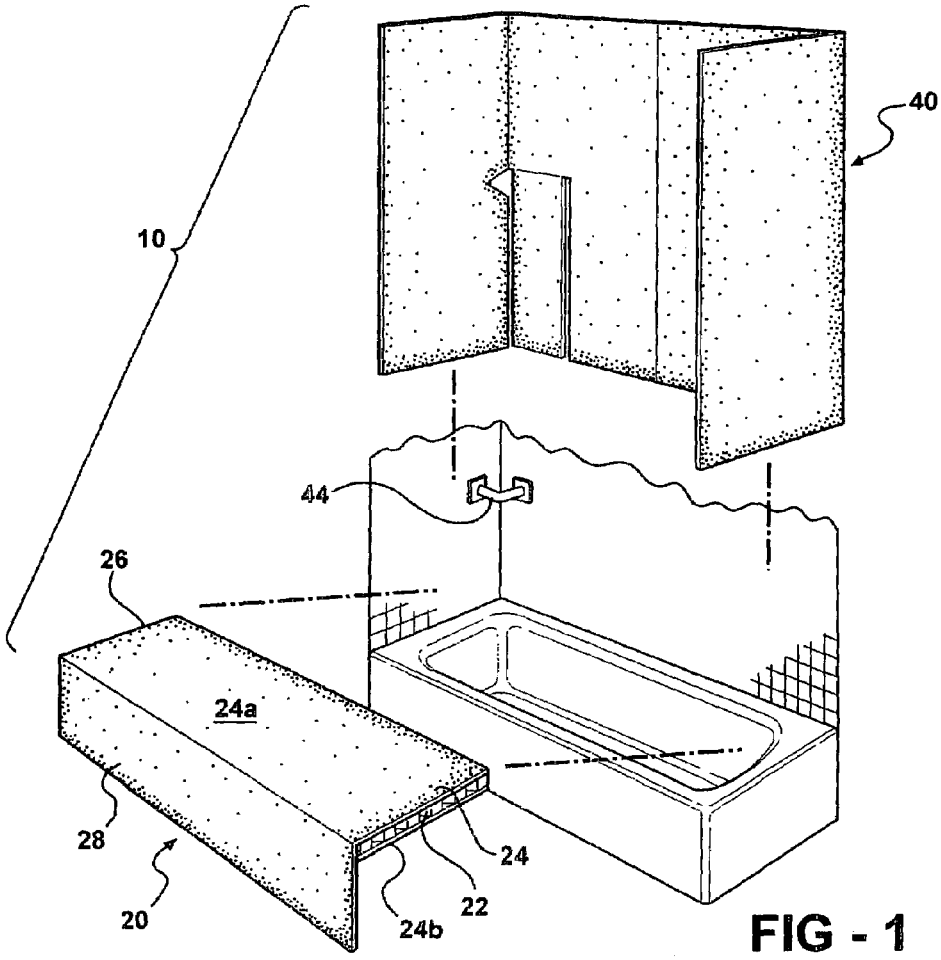
FIG. 1 is a perspective view of a bathtub enclosure embodiment of the present invention, shown as two pieces, with a support platform, a front apron, and a separate wall enclosure covering.
Figure 2:
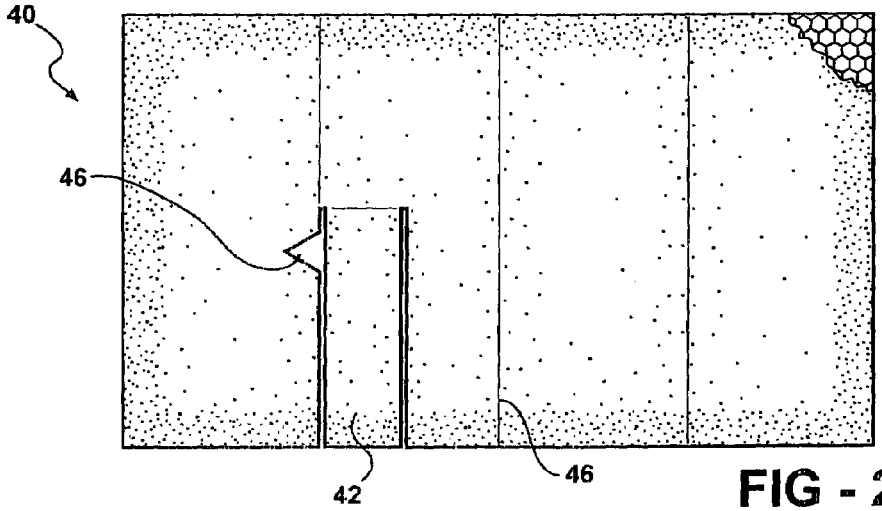
FIG. 2 is a top plan view of a die cut wall enclosure honeycomb configuration protective covering, showing cut out portions for a bathtub wall shelf.

In order that the present invention may be more fully understood, it is described herein with reference to the accompanying figures in which FIG. 1 is a perspective view of a bathtub with a front wall and surrounding walls and a multiple protective assembly 10 of the present invention having a support frame and a wall frame generally denoted by numerals 20 and 40, respectively. The perspective view of FIG. 1 discloses that when the support platform 26 of the support frame 20 is positioned over the bathtub, the skirt 28 of the support frame 20 extends below the support platform 26 to protect the front wall of the bathtub, and the wall frame 40 can be positioned over the bathtub surrounding walls to protect the surrounding walls. FIG. 2 is a two dimensional view of the wall frame 40 of a multiple protective assembly 10 of the present invention covering a finished wall surface.

Figure 3:
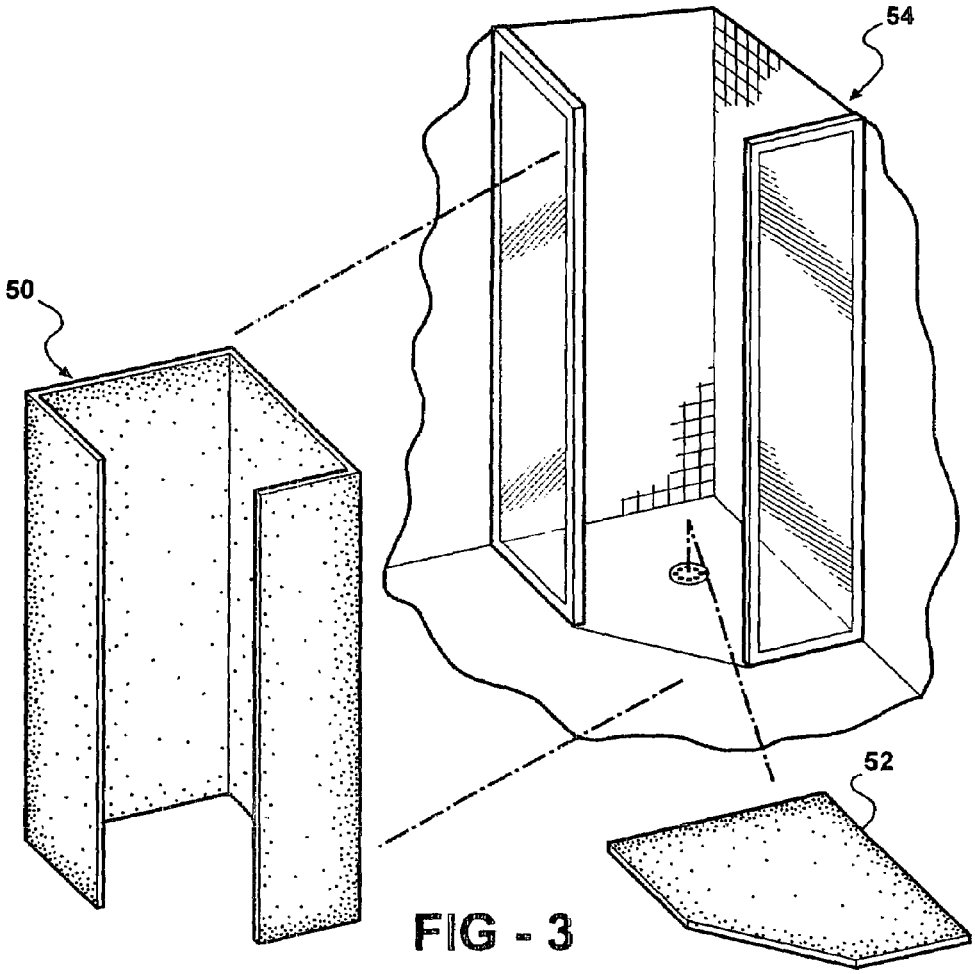
FIG. 3 is a perspective view of the shower stall embodiment of the present invention, shown in two pieces.
Figure 4:
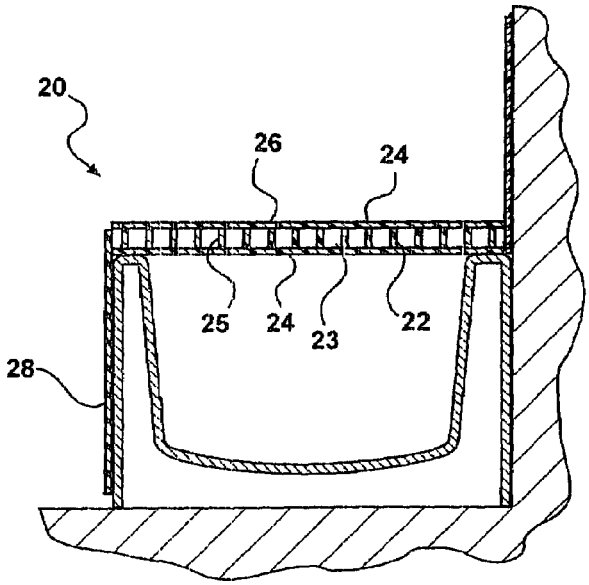
FIG. 4 is a side elevational view of the bathtub embodiment, illustrating the relative placement of the support platform, front apron and wall enclosure protective covering in accordance with the present invention.

FIG. 3 is a perspective view of a wall frame 50 of the present invention and a shower enclosed by surrounding walls, suggesting the placement of the wall frame 50 within a shower unit, while FIG. 4 is a cross-sectional view of an embodiment of a support frame 20 of the present invention having a support platform 26 and a skirt 28. The support platform 26 is positioned to support weight and protect an interior and a rail section of a bathtub. The skirt 28 of the support frame 20 of the present invention is shown connected to and extending in a perpendicular manner from the support platform 26 in order to protect a front wall of the bathtub.

The invention is not limited in its application to the details of its construction or to the arrangements of the components set forth in the following description or illustrations in the drawings. The invention is capable of other embodiments and of being practiced and carried out in various ways. Also, the phraseology and terminology employed herein are for the purpose of description and should not be regarded as limiting.

In view of the foregoing disadvantages inherent in the known types of protective coverings, the present invention provides a new protective covering for precious finished surfaces. To attain this, FIG. 1 illustrates one embodiment of the present invention which includes a support frame generally denoted by numeral 20. The support frame 20 is formed from a protective sheet 22 that is scratch-resistant and a rigid sheet 24 having an upperside 24*a* and an underside 24*b* and being capable of maintaining its structure and sufficiently laminatable in order to support a weight of at least 250 kilograms.

In the broadest embodiment, the support frame 20 is contoured to fit the dimensions of a finished surface of any bathroom-type appliance, including bathtubs, showers, hot tubs, waterjet-type tubs, and the like. The support frame 20 can cover multiple dimensions of the finished surface and support at least 250 kilograms in order to protect the surface.

In a preferred embodiment as shown in FIG. 1, the protective sheet 22 is a die cut honeycomb material and is bonded to the underside 24*b* of the rigid sheet 24. The rigid sheet 24 and the protective sheet 22 together form the support frame 20. The support frame 20 is pre-scored to fit snugly around any interior walls and plumbing fixtures, as well as to form a support platform 26 adequate for supporting substantial weight. Preferably, the die cut dimensions are adapted for fitting in a standard sized bathtub enclosure, although it is envisioned by the present inventors that any particular size may be specified and cut without any undue experimentation. In addition, apron 28 drapes over a front wall of the finished surface, such as a front wall of a bathtub, in a manner relatively perpendicular to the support platform 26. The support platform 26 rests horizontally on opposing longitudinal side rails of the bathtub.

FIG. 2 illustrates the back curtain 40 for protecting the walls of the bathtub enclosure, as well as the cut-out portion 42 for being directed around a short handrail 44 as seen in FIG. 1. The back curtain 40 is also made out of a corrugated cardboard, and acts to protect the tub enclosure material from damage. Cut-out portion 42 may be adapted to accommodate anything that projects from the wall, such as shelves, razor hangers, and the like. Additional protective covering material may be placed over such obstacles to protect them as well.

For all the embodiments, there are a variety of materials from which the protective sheet 22 and the rigid sheet 24 may be manufactured, including, but not limited to, the following materials. The protection sheet 22 includes a double skinned sheet material that may be constructed from, or has an outer layer (or layers) constructed from, a scratch-resistant material such as polyurethane, cloth, cotton, smooth synthetic materials or other scratch-resistant materials. The rigid sheet 24 may be constructed from a large number of weight bearing plastic or paper products such as molded pulp, cardboard and corrugated cardboard, with or without reinforcing materials therebetween. Rigid sheet 24 may be an integral piece with apron 28, or may be a separate piece, which can be constructed of materials such as plastic, corrugated plastic, rigid thermoplastic sheet, high-density foam or rigid urethane foam, corrugated cardboard or paper. In another preferred embodiment, the protective sheet 22 may be sandwiched between two rigid sheets 24 when the rigid sheet 24 has a scratch-resistant finish.

The double skinned material is generally a sheeted material having a center material between the two skins, with a thickness of from about ⅛" to about 5" thick, and may be made of any double skinned sheet material including corrugated plastic, cardboard, paper, foamed skinned materials or lightweight plastic composites utilizing more rigid portions over the bathtub recess and less rigid portions for the wall curtain and the apron. The two skins of the sheet material may either be the same material, or may be different materials. For example, a plastic honeycomb configuration may use a flexible sheet of plastic to be used as a living hinge, while the other skin may be a rigid plastic to protect the finish of the bathroom fixture, having the honeycomb cell structure between the flexible and the rigid plastic sheets. The corrugated plastic embodiment may be made of polypropylene, polyethylene, or any other commercially available corrugated plastic, so long as it is lightweight and will not mar the bathroom fixture surface. Further, the double skinned sheet material may be a plastic or paper honeycomb construction having individual honeycomb cell sizes of from about ¼" to about 1" diameter. In addition, a double skinned sheet material may be used that has two outer skins and foamed materials 23 thereinbetween. Reinforcement materials 25 may be incorporated into and surrounded by the center foam, either open cell, closed cell or foamed-in-place or pre-foamed, to add to the rigidity of the unit especially over the bathtub recess, thereby enhancing the weight bearing capacity of the protective covering. As the reinforcement will be suspended within the foam core, and will not contact the bathroom fixture surface, it may be of any high strength, yet lightweight material, such as a metal mesh or metallic spun web, both of which are very lightweight and inexpensive. Further contemplated reinforcements may include carbon fabrics, fibers of any type, sheet metals and plastics, lightweight reconstituted stone structures, or any other rigid reconstituted sheet material, as well as foraminous materials.

Furthermore, the sheeted material utilized may be made of multiple layers in each skin, or may be ribbed or textured over the entire area of the sheet material, or over merely portions of the area. For example, under the support platform, a ribbed structure would add strength, without adding much additional weight to the protective covering device. The present inventors have contemplated the use of a textured surface on the support platform to aid in surefootedness for any worker that might be standing thereon.

The protective covering 10 can be manufactured solely as a support frame 20 or as a multiple protective assembly to protect multiple finished areas. By way of example, a multiple protective assembly 10 protects a bathtub/shower with the support frame 20 and the wall frame 40 for protecting any walls surrounding the bathtub/shower.

Most preferably, for the preferred embodiment of a bathtub enclosure, the present invention includes a two-piece heavy double skinned sheet material preferably made of honeycombed or corrugated cardboard or polypropylene protective device. The first piece 40 as shown in FIG. 1 includes a first thickness of sheet material for protecting the wall covering portion of the bathtub enclosure protector against nicks and paint, and is preferably from about ¼ inch thick to about 1 inch thick. The second piece 20 as shown in FIG. 1 includes a second, thicker piece of sheet material for horizontally covering the bathtub itself to hold a worker weighing up to 500 pounds. This second piece of sheet material preferably has a thickness of at least one inch, and most preferably having a thickness of about two to five inches. This second piece of sheet material should be thick enough to hold at least 500 pounds, to allow a drywalling contractor to stand on the support platform of the bathtub protecting device, after it is in place over the installed bathtub, so that he can reach the drywall application above the tub.

As the tub must be installed before the drywall, the construction protective covering of the present invention permits the drywall workers to carry out their jobs after the bathtub has been installed, without harming or marring the surface of the bathtub. Previously, in many cases, the bathtub would be installed, and then the drywall installers would stand on the edge of the tub to install the drywall, mud and tape the seams, and then the painting/wallpapering contractors would stand on the edge of the tub to do their jobs. Each one of the later contractors could damage the bathtub itself by dropping tools, spilling paint, etc. This would involve clean up at the very least, repair in the majority of the cases, usually averaging a cost of around $300. The present invention allows them to do their jobs without worrying about harming the bathtub.

Needless to say, other embodiments may include the protective device being made of a single piece of the double skinned sheet material, and then being reinforced with a thicker piece of sheet material over the portion which rides horizontally over the bathtub, in order to be able to support more weight. Alternatively, for ease of shipping, handling and construction, the construction protective device of the present invention may be made in a multitude of pieces. In addition, one piece can be replaced in the event of extreme damage during a previous job.

A protective covering, as described in the present invention in the form of a support frame 20 or a multiple protective assembly 10, may be custom cut and shaped, i.e., post-formed, for easy installation. It may be made of any suitable number of pieces, as needed, for shipping and assembly. Needless to say, a one piece assembly is also contemplated by these inventors. FIG. 3 shows another embodiment for a shower stall protective assembly. Shown is a two piece assembly, although a one piece unit is also feasible, by forming a die cut piece with the floor extension extending from the bottom of the wall curtain protective covering device, ready to be folded into place. Connections for the various pieces may include living hinges, sturdy duct-type tapes, plastic sheet hinges with adhesives to secure both pieces together, and any other conventional means of securing two pieces of sheet material together.

Therefore, the advantages and objects enumerated above have been met or exceeded by the present invention, in which a protective covering for construction items is provided. The protective covering shall be strong enough to support the weight of a full grown man, and is designed to protect bathroom appliances after they have been installed, but before the remainder of the bathroom has been finished off with drywall and other finishes.

What is claimed is:

1. A construction protective covering for a bathtub, said covering comprising:

a light-weight, multi-layer, disposable, size adjustable protective covering having at least two layers of materials bonded together to form a strong covering, said protective covering being sized to cover a bathtub having a bathtub recess and a front face, and wherein said at least two layers of materials bonded together have a collective thickness of from 1" to about 5" thick, and wherein said protective covering is adapted to be custom cut on-site easily for post-forming the covering to any specific particular size and configuration of the bathtub being covered, and wherein each of the at least two bonded layers includes a double skinned sheet material made of a corrugated material selected from the group consisting of corrugated cardboard, corrugated paper and corrugated plastic, including polypropylene and polyethylene, wherein one of the at least two layers is a rigid sheet material constructed in a honeycomb configuration having an individual cell size of between about ¼" to about 1" and is from about 1" to about 5" thick, and wherein another of the at least two layers is made of a protective double skinned material being selected from the group consisting of corrugated cardboard, corrugated paper, corrugated plastic, and foamed skin materials;

an apron attached to said protective covering to protect the front face of the bathtub; and said multi-layer protective covering being capable of holding the weight of a heavy construction worker, such that when the construction worker stands on the protective covering over the bathtub to do more work, the worker will be supported by the protective covering so that the worker can work without having to be careful of the delicate finish, whereby damage due to dropped tools and construction workers working in the vicinity of the installed components is minimized.

2. The covering of claim 1, wherein the double skinned sheet material may include a foamed core construction selected from the group consisting of open cell, closed cell, foamed in place, pre-foamed and reinforced foam.

3. The covering of claim 2, wherein the foamed core construction may further include reinforcements located within and surrounded by the foam, and said reinforcements being selected from the group consisting of metal woven mesh, metal non-woven webbing, carbon fiber, fiberglass fibers, fabrics, and foraminous materials.

4. A construction protective covering for a shower stall enclosure, said covering comprising:

a light-weight, multi-layer, disposable, size adjustable, double skinned, sheeted material protective covering having at least two layers of materials bonded together to form a strong covering, said protective covering being sized to install within and cover a shower stall enclosure including its floor, and wherein said at least two layers of materials bonded together have a collective thickness of from about 1" to about 5" thick, and wherein said protective covering is adapted to be custom cut on-site easily for post-forming the covering to any specific particular size and configuration of the shower stall enclosure being covered, and wherein each of the at least two bonded layers includes a double skinned sheet material made of a corrugated material selected from the group consisting of corrugated cardboard, corrugated paper and corrugated plastic, including polypropylene and polyethylene, wherein one of the at least two layers is a rigid sheet material constructed in a honeycomb configuration having an individual cell size of between about ¼" to about 1" and is from about 1" to about 5" thick, and wherein another of the at least two layers is made of a protective double skinned material selected from the group consisting of corrugated cardboard, corrugated paper, corrugated plastic, and foamed skin materials;

said multi-layer protective covering being capable of holding the weight of a heavy construction worker, such that when the construction worker stands on the protective covering over the shower stall enclosure floor to do more work, the worker will be supported by the protective covering so that the worker can work without having to be careful of the delicate finish, whereby damage due to dropped tools and construction workers working in the vicinity of the installed components is minimized.

5. The covering of claim 4, wherein the double skinned sheet material includes a foam selected from the group consisting of open cell, closed cell, foamed in place, pre-foamed and reinforced foam.

6. The covering of claim 5, wherein the foam may further include reinforcements located within and surrounded by the foam, and said reinforcements being selected from the group consisting of metal woven mesh, metal non-woven webbing, carbon fiber, fiberglass fibers, fabrics, and foraminous materials.

* * * * *